US011509104B2

(12) United States Patent
Halbig

(10) Patent No.: US 11,509,104 B2
(45) Date of Patent: Nov. 22, 2022

(54) SHORT-CIRCUIT PROBE, PLUG-IN CONNECTION WITH SUCH A SHORT-CIRCUIT PROBE AND A METHOD FOR PRODUCING SUCH A SHORT-CIRCUIT PROBE

(71) Applicant: MD ELEKTRONIK GmbH, Waldkraiburg (DE)

(72) Inventor: Thomas Halbig, Dietfurt (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 17/167,120

(22) Filed: Feb. 4, 2021

(65) Prior Publication Data

US 2021/0257794 A1 Aug. 19, 2021

(30) Foreign Application Priority Data

Feb. 17, 2020 (DE) ..... 10 2020 104 022.9

(51) Int. Cl.
*H01R 31/08* (2006.01)
*H01R 13/05* (2006.01)
(Continued)

(52) U.S. Cl.
CPC ..... *H01R 31/08* (2013.01); *H01R 13/05* (2013.01); *H01R 13/432* (2013.01); *H01R 13/50* (2013.01);
(Continued)

(58) Field of Classification Search
CPC ..... H01R 31/08; H01R 31/085; H01R 13/05; H01R 13/432; H01R 13/50;
(Continued)

(56) References Cited

U.S. PATENT DOCUMENTS 4,666,231 A * 5/1987 Sheesley ..... H01R 24/46 439/736
5,256,082 A * 10/1993 Yaegashi ..... H01R 12/596 439/497

(Continued)

FOREIGN PATENT DOCUMENTS

DE 102004026264 A1 2/2005
DE 202019104312 U1 10/2019

*Primary Examiner* — Gary F Paumen
(74) *Attorney, Agent, or Firm* — Leydig, Voit & Mayer, Ltd.

(57) ABSTRACT

A short-circuit probe for short-circuiting an inner conductor with an outer conductor in a multiway coaxial plug includes an electrically-conductive contact spring comprising a holding and stabilizing section and a contacting section. The contacting section is bent and comprises an inner-conductor contact section and an outer-conductor contact section. A housing comprises: a receiving space; an inner-conductor insertion opening in a first end face, via which the short-circuiting inner conductor of the multiway coaxial plug can be inserted into the receiving space and can be brought into contact with the inner-conductor contact section; and a laterally and/or radially aligned outer-conductor contacting opening, wherein the outer-conductor contact section of the contact spring passes through the outer-conductor contacting opening and can be brought into contact with the outer conductor. The contact spring is arranged inside the receiving space and extends over a predominant length of the housing.

16 Claims, 15 Drawing Sheets

(51) Int. Cl.

| | |
|---|---|
| ***H01R 13/432*** | (2006.01) |
| ***H01R 13/50*** | (2006.01) |
| ***H01R 13/703*** | (2006.01) |
| ***H01R 25/00*** | (2006.01) |
| ***H01R 27/02*** | (2006.01) |
| ***H01R 43/16*** | (2006.01) |
| ***H01R 43/20*** | (2006.01) |
| ***H01R 24/38*** | (2011.01) |
| ***H01R 103/00*** | (2006.01) |

(52) U.S. Cl.
CPC ..... *H01R 13/7032* (2013.01); *H01R 25/003* (2013.01); *H01R 27/02* (2013.01); *H01R 43/16* (2013.01); *H01R 43/20* (2013.01); *H01R 24/38* (2013.01); *H01R 2103/00* (2013.01); *H01R 2201/20* (2013.01)

(58) Field of Classification Search
CPC .. H01R 13/7032; H01R 25/003; H01R 27/02; H01R 43/16; H01R 43/20; H01R 24/38; H01R 2103/00; H01R 2201/20
USPC ..... 439/507, 510, 513
See application file for complete search history.

(56) References Cited

U.S. PATENT DOCUMENTS

| | | | | |
|---|---|---|---|---|
| 5,639,258 | A * | 6/1997 | Clark | H01R 13/703 439/699.1 |
| 6,595,792 | B1 * | 7/2003 | Rudolph | H01R 13/6397 439/490 |
| 2002/0006752 | A1 * | 1/2002 | Sato | H01R 31/08 439/701 |
| 2002/0155753 | A1 * | 10/2002 | Yamanashi | H01R 13/5219 439/509 |
| 2008/0014786 | A1 * | 1/2008 | Brodsky | H01R 13/631 439/501 |
| 2010/0323564 | A1 * | 12/2010 | Clark | H01R 13/26 439/862 |
| 2014/0364011 | A1 | 12/2014 | Tanaka | |
| 2015/0056839 | A1 | 2/2015 | Zhang | |
| 2017/0244204 | A1 | 8/2017 | Smith et al. | |

* cited by examiner

SHORT-CIRCUIT PROBE, PLUG-IN CONNECTION WITH SUCH A SHORT-CIRCUIT PROBE AND A METHOD FOR PRODUCING SUCH A SHORT-CIRCUIT PROBE

CROSS-REFERENCE TO PRIOR APPLICATION

Priority is claimed to German Patent Application No. DE 10 2020 104 022.9, filed on Feb. 17, 2020, the entire disclosure of which is hereby incorporated by reference herein.

FIELD

The invention relates to a short-circuit probe, a plug-in connection with such a short-circuit probe and a method for producing such a short-circuit probe.

BACKGROUND

Due to the ever-increasing number of electrical devices, the desire to connect different electronic devices to each other is also increasing. This is done by establishing a corresponding plug-in connection by means of two plugs. Such a plug-in connection can be faulty, which then leads to the failure of a communication connection between the two electrical devices. On the one hand, a faulty plug-in connection can emerge over time when, for example, forces act on the plug-in connection. On the other hand, a plug-in connection can be incorrectly established right from the start because the two plugs have not been plugged into each other with the required force. The subsequent effort for rectifying the faulty plug-in connection can sometimes be very high. The detection of a faulty plug-in connection is therefore important.

DE 20 2019 104 312 U1 discloses a test plug that makes it possible to short-circuit a coaxial plug. This test plug is inserted into a coaxial plug. If a plug-in connection to another coaxial plug is established via this coaxial plug, its inner conductor will be short-circuited with its outer conductor. This can be detected at an early stage via a corresponding control device, and the plug-in connection, which has further connections as well, can be repaired accordingly. The test plug comprises a contact spring which simultaneously contacts and thus short-circuits an inner conductor and an outer conductor. The contact spring is held by a housing. The housing comprises a receptacle for the short-circuiting inner conductor. When the inner conductor is inserted into the receptacle, contact is made with the contact spring. Another part of the contact spring is used for contacting the outer conductor and projects from the housing. The contact spring is pushed into the housing in the same direction as the inner conductor later on. The contact spring increases in width from the contacting end and comprises slotted latching wings. The test plug shown can be manufactured only with great difficulty, especially in an automated manner. This applies all the more the smaller the coaxial plugs are. In the case of inner conductors having a diameter of less than 1 mm, the contact spring is inherently very unstable. The inner conductors of the coaxial cable to be accommodated can in the case of micro-coaxial lines have a diameter of approximately 0.4 mm. The dimensions which a necessary test plug must have are correspondingly small. The assembly of the test plug from the prior art is therefore highly problematic for such dimensions and cannot be achieved in an automated manner.

SUMMARY

In an embodiment, the present invention provides a short-circuit probe for short-circuiting an inner conductor with an outer conductor in a multiway coaxial plug of a plug-in connection. The short-circuit probe includes a contact spring for short-circuiting which consists of or comprises an electrically conductive material. The contact spring comprises a holding and stabilizing section and a contacting section. The contacting section is bent and comprises an inner-conductor contact section and an outer-conductor contact section which are spaced apart from one another perpendicularly to a longitudinal axis of the contact spring. The short-circuit probe further comprises a housing which comprises: a receiving space extending along a longitudinal direction of the housing; an inner-conductor insertion opening in a first end face of the housing, via which the short-circuiting inner conductor of the multiway coaxial plug can be inserted into the receiving space at least over a part of its length and can be brought into contact with the inner-conductor contact section; and a laterally and/or radially aligned outer-conductor contacting opening, wherein the outer-conductor contact section of the contact spring passes through the outer-conductor contacting opening and can be brought into contact with the outer conductor. The contact spring is arranged inside the receiving space of the housing and extends over a predominant length of the housing

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1A:
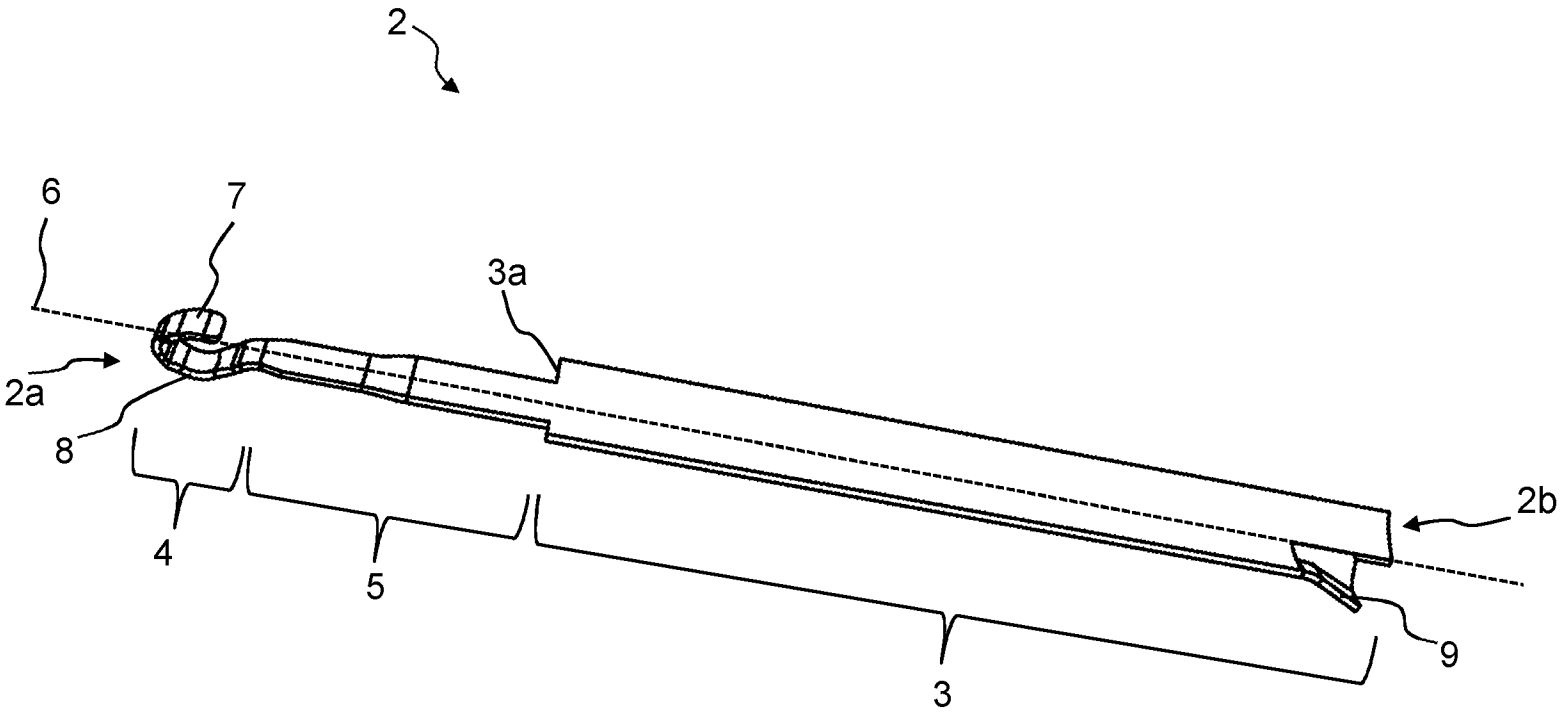
FIGS. 1A, 1B: various views of a contact spring of the short-circuit probe according to an embodiment of the invention.

In an embodiment, the present invention provides a short-circuit probe for short-circuiting an inner conductor with an outer conductor in a multiway coaxial plug of a plug-in connection, which comprises an improved structure and is suitable for accommodating even the smallest inner conductor diameters, wherein production of this short-circuit probe is possible in an automated manner.

The short-circuit probe according to an embodiment of the invention comprises a contact spring which consists of or comprises an electrically conductive material. Via the contact spring, the inner conductor is electrically (galvanically) connected to the outer conductor via a low-resistance connection and is thus short-circuited. In contrast to the prior art, the contact spring comprises a holding and stabilizing section in addition to a contacting section. Both sections extend along a longitudinal axis of the contact spring. The contacting section is bent and comprises an inner-conductor contact section and an outer-conductor contact section that are spaced apart from each other perpendicularly or transversely to the longitudinal axis of the contact spring. The contacting section is preferably designed in a spring-loaded manner with respect to the holding and stabilizing section. In addition, the inner-conductor contact section may also be designed in a spring-loaded manner with respect to the outer-conductor contact section. A housing delimits a receiving space extending along, in particular, the entire length of the longitudinal direction of the housing.

At its first end face, the housing comprises an inner-conductor insertion opening, via which the short-circuiting inner conductor can be inserted into the receiving space at least over a part of its length. In the inner-conductor insertion opening, the short-circuiting inner conductor can be brought into electrically conductive contact with the inner-conductor contact section. The housing also has a lateral outer-conductor contacting opening, which is preferably arranged offset by 90° from the inner-conductor insertion opening. The outer-conductor contact section projects through the outer-conductor contacting opening and can thereby be brought into electrically conductive contact with the outer conductor that is to be received. It is particularly advantageous for the contact spring to be arranged within the receiving space of the housing and to extend over the predominant length of the housing.

Since the contact spring extends over the predominant length of the housing, the dimensioning of the contact spring can be selected even in the case of just a very small contacting section in such a way that a comparatively simple, preferably automated, handling is possible. In this way, embodiments of the invention can also be used with very small plug connectors which have, for example, an outer conductor diameter of 2 to 3 mm.

In order to further increase the stability, a development provides that the inner-conductor insertion opening and the outer-conductor contacting opening are two separate openings which are separated from each other on the outside by a part of the housing. This increases the stability of the housing, above all in the region of the first end face. In this case, the contact spring preferably does not have branches. The inner-conductor contact section and the outer-conductor contact section are arranged one after the other.

In order to further increase the stability, the inner-conductor contact section is bent back relative to the outer-conductor contact section, in particular by 180°, and thus forms a first end of the contact spring. Basically, the outer-conductor contact section can also be bent back relative to the inner-conductor contact section. The contacting section may have an unciform shape. It is particularly advantageous here for the greater part of the contact spring to be arranged within the housing and for only the bent-back part of the outer-conductor contact section to project from the corresponding outer-conductor contacting opening. In the prior art, the predominant part of the contact spring is accessible from outside the housing, which brings stability problems with it and means that the contact spring can be damaged more easily.

The housing can have a separate contact-spring insertion opening via which the contact spring can be inserted into the receiving space. The contact-spring insertion opening is arranged in particular in the region of a second end face of the housing. The inner-conductor insertion opening and the contact-spring insertion opening are therefore preferably formed at two opposite ends of the housing. The contact spring is inserted into the contact spring opening with its contacting section first and pushed forward in the direction of the inner-conductor insertion opening. In the prior art, this is done exactly the other way around. Here, the widened section is inserted first and the filigree contacting section last. The problem from the prior art of how the contact spring is ultimately to be held when it is being pushed in does not arise in an embodiment of the present invention because the contact spring can be held at the free end of the holding and stabilizing section without any problems and can be inserted into the contact-spring insertion opening with the contacting section first.

The holding and stabilizing section of the contact spring has a convex cross-sectional geometry. It is also possible to speak of a curvature of the holding and stabilizing section transversely to the longitudinal axis. As a result, not only can the receiving space be enlarged, wherein the contact spring is still arranged in the receiving space without play as before, which simplifies the production of the housing. At the same time, the convex profile also increases the stability of the entire contact spring. As a result, a greater length of the contact spring can also be realized, so that it extends in particular over the predominant part of the length of the housing. The at least one holding and stabilizing section may have a height of preferably less than 0.8 mm, more preferably less than 0.5 mm, most preferably less than 0.4 mm.

The plug-in connection according to an embodiment of the invention comprises a first and a second multiway coaxial plug, in particular in the form of a micro multiway coaxial plug, wherein the second multiway coaxial plug is the mating connector of the first multiway coaxial plug. The first multiway coaxial plug comprises at least two connections. It could also comprise three, four, five, six, seven, eight, or more than eight connections. The same also applies to the second multiway coaxial plug. The short-circuit probe is arranged in a first connection of the first multiway coaxial plug. An inner conductor and an outer conductor of a coaxial cable connected to the respective connection are arranged in the at least one second connection. The first and the second multiway coaxial plugs are plugged into one another so that an inner conductor in the first connection of the second multiway coaxial plug enters into the inner-conductor insertion opening of the short-circuit probe and thereby contacts the inner-conductor contact section of the contact spring. An outer conductor in the first connection of the second multiway coaxial plug-in connector contacts the outer-conductor contact section of the contact spring in the plugged-together state. The inner conductor and the outer conductor are thereby electrically conductively connected via the contact spring and short-circuited.

The inner and outer conductors in the second connection of the second multiway coaxial plug-in connector contact the respective inner and outer conductors in the respective corresponding connection in the first multiway coaxial plug-in connector via conventional means. The inner conductors in the connections of the second multiway coaxial plug-in connector can in turn be electrically conductively connected to an inner conductor of a connected coaxial cable. They can also be connected to a plug contact. This also comprises a one-piece construction, according to which the plug contact in the first connection of the second multiway coaxial plug-in connector represents the inner conductor which is inserted into the inner-conductor insertion opening. The plug contact can be soldered to a circuit board. Such a plug contact can preferably emerge from the second multiway coaxial plug at an angle of 90°. The same also applies to the outer conductors of the second multiway coaxial plug.

By connecting the second multiway coaxial plug to a control device, at least that connection where the short-circuit probe according to an embodiment of the invention is mounted can be queried regarding a short circuit. If a short circuit is detected, this is a sign that the plug-in connection has been established properly and corresponding signals can also be transmitted via the other connections.

The method according to an embodiment of the invention for producing the short-circuit probe comprises several method steps. These method steps are aimed in particular at an automated production of the short-circuit probe. In a first method step, a contact spring belt is produced. This contact spring belt comprises a plurality of contact springs which are later placed into corresponding housings. This first method step comprises several method sub-steps. In a first method sub-step, a metal sheet is punched out and/or lasered. Contact springs are punched out or lasered from this metal sheet. These are separated from each other, wherein each contact spring comprises a holding and stabilizing section, a contacting section and a connecting section. The contact springs are held together via a common upper connecting strip and a common lower connecting strip. The connecting section of each contact spring is connected to the upper connecting strip, and the holding and stabilizing section of each contact spring is connected to the lower connecting strip in the region of a respective end. The contact springs are therefore separated from one another and attached individually to the upper and to the lower connecting strips. Subsequently, in a further method sub-step, the contacting section is bent over, in particular into an unciform shape.

In the next method step, the connecting section is separated from the upper connecting strip. Subsequently, in a further method step, the contact spring is introduced into a receiving space of a housing via a corresponding contact-spring insertion opening. The contact spring is inserted into the contact-spring insertion opening with its contacting section first. After the contacting section, the connecting section is inserted, which is no longer attached to the upper connecting strip. The holding and stabilizing section is then inserted. The contact spring itself can be moved towards the housing. However, the housing is preferably moved in the direction of the contact spring. Even a common movement of contact spring and housing would be possible. Finally, the holding and stabilizing section is separated from the lower connecting strip.

The use of the contact spring belt is particularly advantageous because the respective contact springs in this contact spring belt are optimally aligned and can be correspondingly introduced into the respective housings. Such a contact spring belt, which can be rolled up, may comprise a plurality of contact springs and be fed to a corresponding automatic placement machine. An automatic production of the short-circuit probe according to embodiments of the invention is thereby possible.

Some particularly advantageous embodiments of the short-circuit probe are again highlighted below.

The short-circuit probe need not have its own outer conductor.

The short-circuit probe preferably has the following features:

- the holding and stabilizing section and/or the contacting section and/or the connecting section do not have branches.

The short-circuit probe preferably has the following features:

- the contact spring is a punched-out and/or laser-cut part; and
- the contact spring is a bent part.

The short-circuit probe preferably has the following features:

- the contact spring has a thickness at its holding and stabilizing section and/or its contacting section which is less than 2 mm, 1.5 mm, 1.0 mm, 0.8 mm, 0.5 mm or less than 0.4 mm. The thickness of the contact spring 2 at its holding and stabilizing section 3 is preferably about 0.15 mm.

The short-circuit probe preferably has the following features:

- the contact spring has a length which is less than 5 cm, 3 cm, 2 cm or which is less than 1 cm. Most preferably, the contact spring has a length of 2.5 cm; and
- the housing has a length which is less than 7 cm, 5 cm, 3 cm, 2 cm or which is less than 1.5 cm and which is preferably more than 0.8 cm, 1.5 cm, 2.5 cm, 3.5 cm, 4.5 cm or is more than 6.5 cm. Most preferably, the housing has a length of 2.5 cm.

The short-circuit probe preferably has the following feature:

- the short-circuit probe does not have a soldered connection and/or screw connection and/or adhesive connection.

The short-circuit probe preferably has the following feature:

- the inner-conductor insertion opening and the outer-conductor contacting opening are smaller than the contact-spring insertion opening, so that the holding and stabilizing section can only be inserted into the receiving space through the contact-spring insertion opening.

The short-circuit probe preferably has the following feature:

- the housing is made of or comprises a dielectric material such as plastic; or
- the housing is made of or comprises an electrically conductive material.

The short-circuit probe preferably has the following features:

- the housing is penetrated by the receiving space along its entire longitudinal axis; and/or
- the inner conductor is contacted via precisely one contacting section with precisely one inner-conductor contact section of the contact spring; and/or
- the outer conductor is contacted via precisely one contacting section with precisely one outer-conductor contact section of the contact spring; and/or
- the contact spring consists of sheet metal or comprises sheet metal.

Figure 1B:
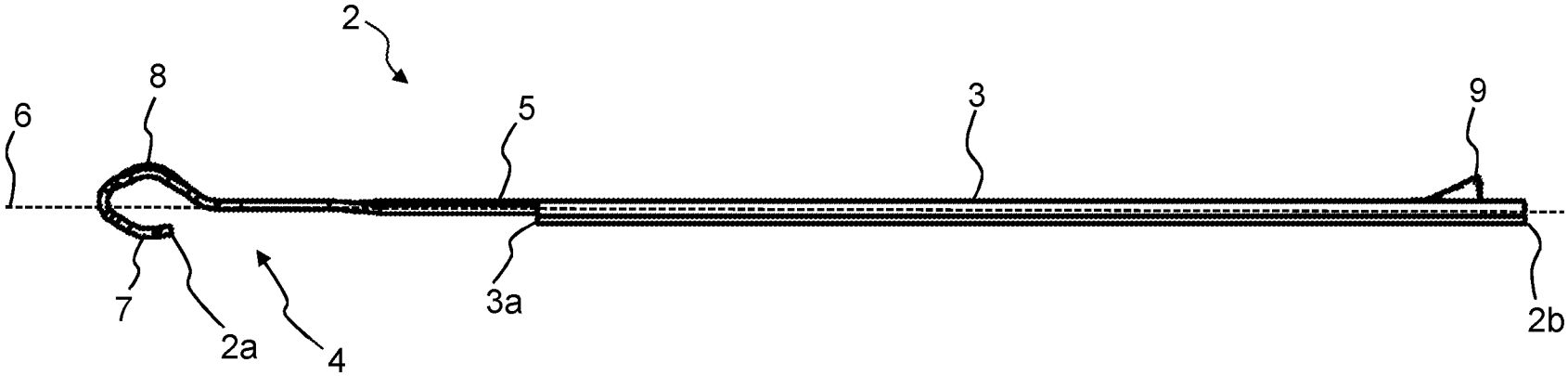

Referring to the Figures, the short-circuit probe 1 according to an embodiment of the invention is described below. The short-circuit probe 1 comprises a contact spring 2 and a housing. FIGS. 1A and 1B show different views of a first exemplary embodiment of this contact spring 2. The contact spring 2 comprises a holding and stabilizing section 3 and a contacting section 4. Between the two sections 3, 4 there is a connecting section 5. The contacting section 4 is bent over by 180° so that an unciform shape is formed. It comprises an inner-conductor contact section 7 and an outer-conductor contact section 8 which are spaced apart from each other perpendicularly or transversely to the longitudinal axis 6. The contact spring 2 is formed in one piece. It represents a first end 2*a* of the contact spring 2. A second end 2*b* of the contact spring 2 is formed by the free end of the holding and stabilizing section 3.

In the present exemplary embodiment, the holding and stabilizing section 3 is wider than the connecting section 5 and in particular also wider than the contacting section 4. At least two stop faces 3*a* are formed on the holding and stabilizing section 3 at the transition between the holding and stabilizing section 3 and in the connecting section 5 so that the connecting section 5 continues approximately centrally on the holding and stabilizing section 3. The stop faces 3*a* can be brought into contact with a corresponding stop counterface inside the housing, not shown.

FIGS. 2A, 2B, 2C, 2D and 2E show various detailed views of one embodiment of the contact spring 2.

Figure 3A:
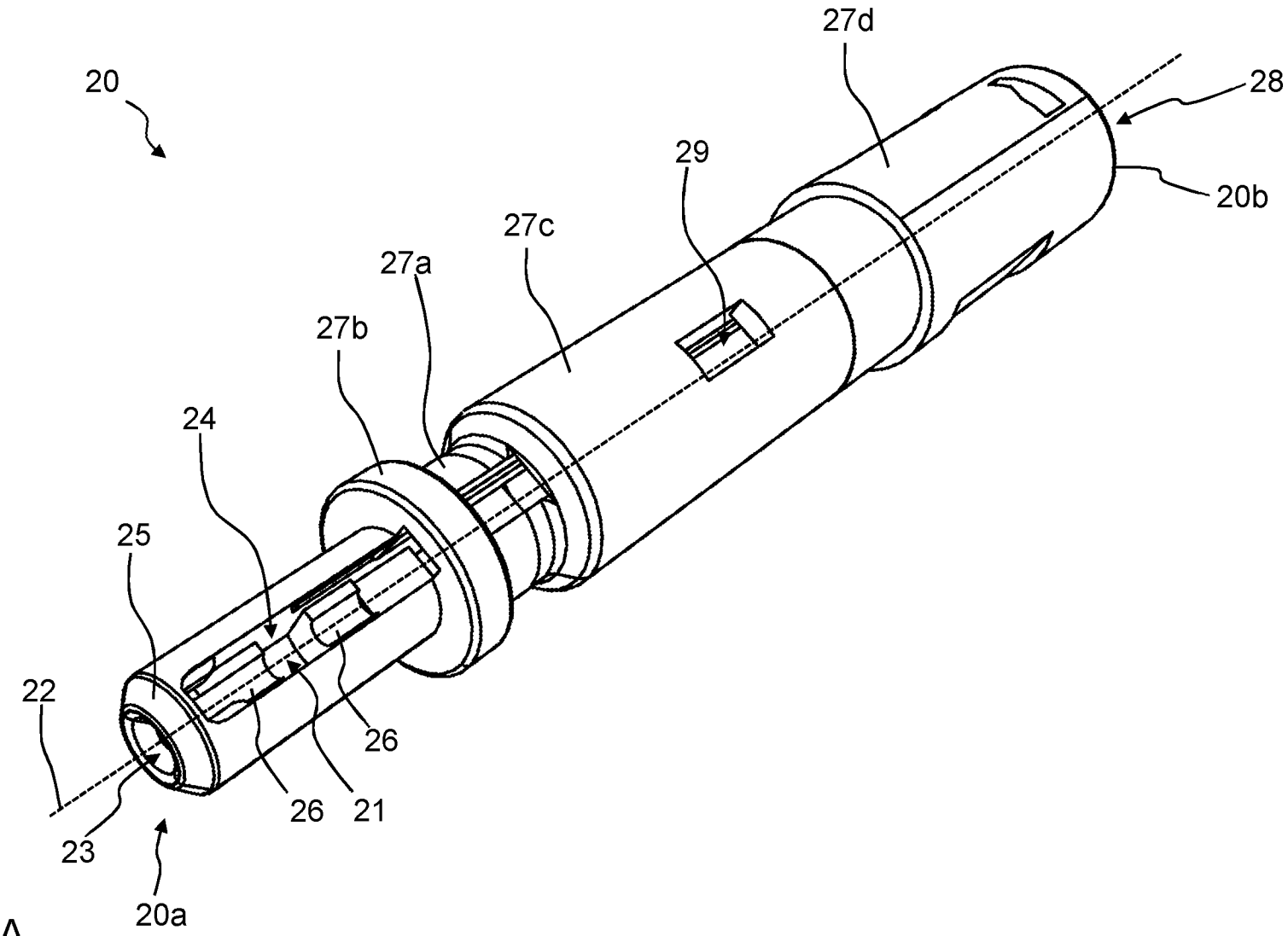
FIGS. 3A, 3B: various views of a housing of the short-circuit probe according to an embodiment of the invention.
Figure 3B:
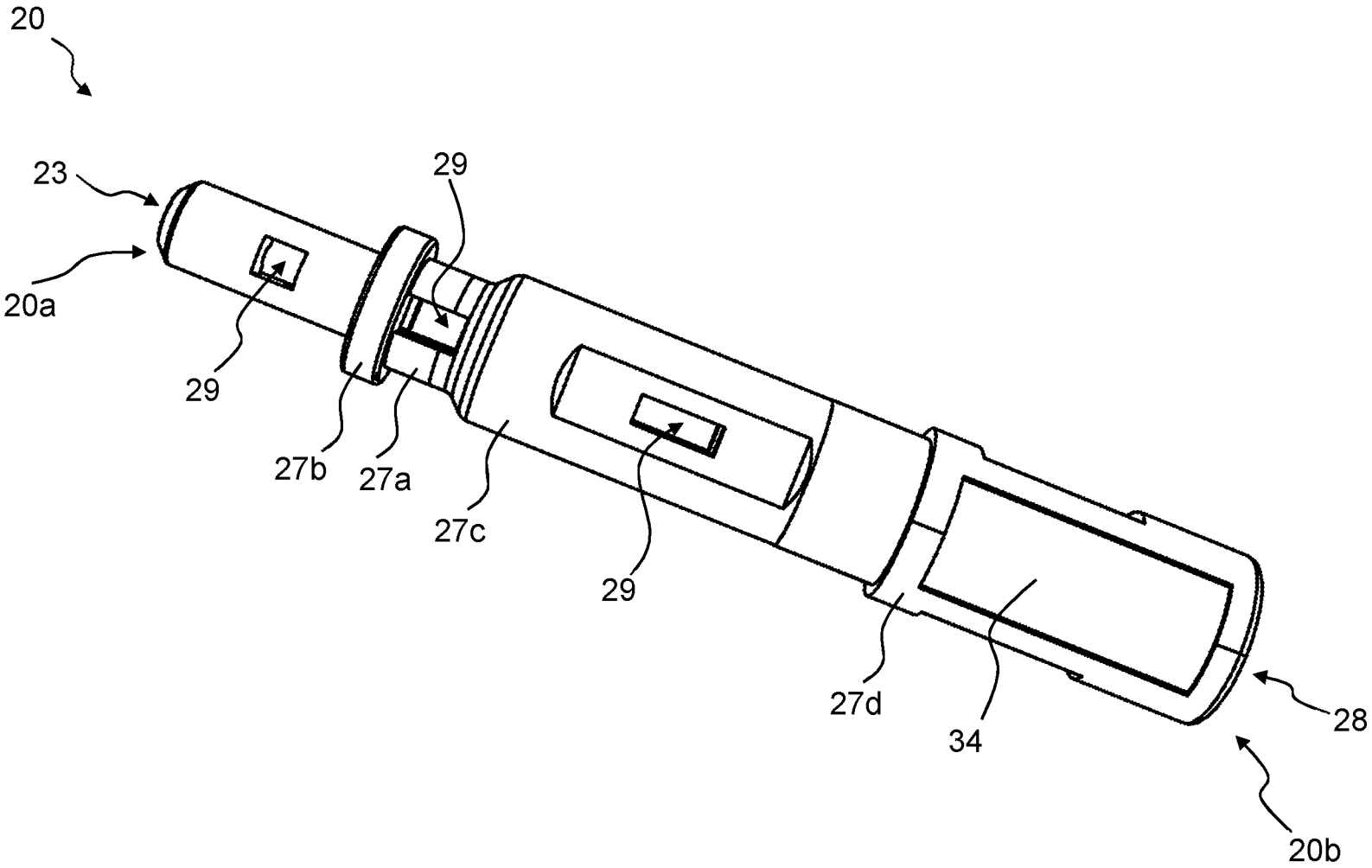
Figure 5A:
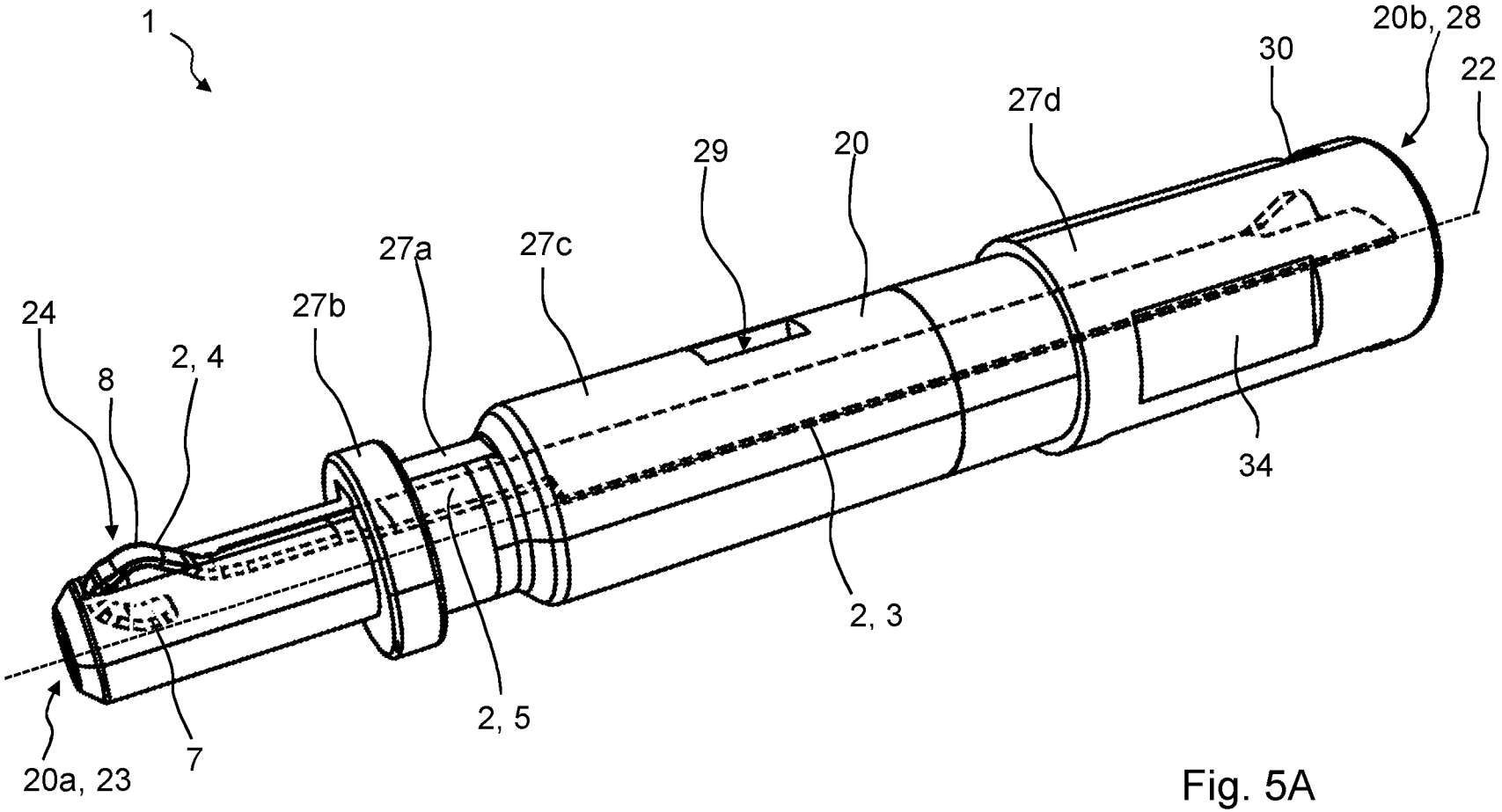
FIGS. 5A, 5B, 6: various views of the short-circuit probe according to an embodiment of the invention, wherein the contact spring has been placed into the housing.
Figure 5B:
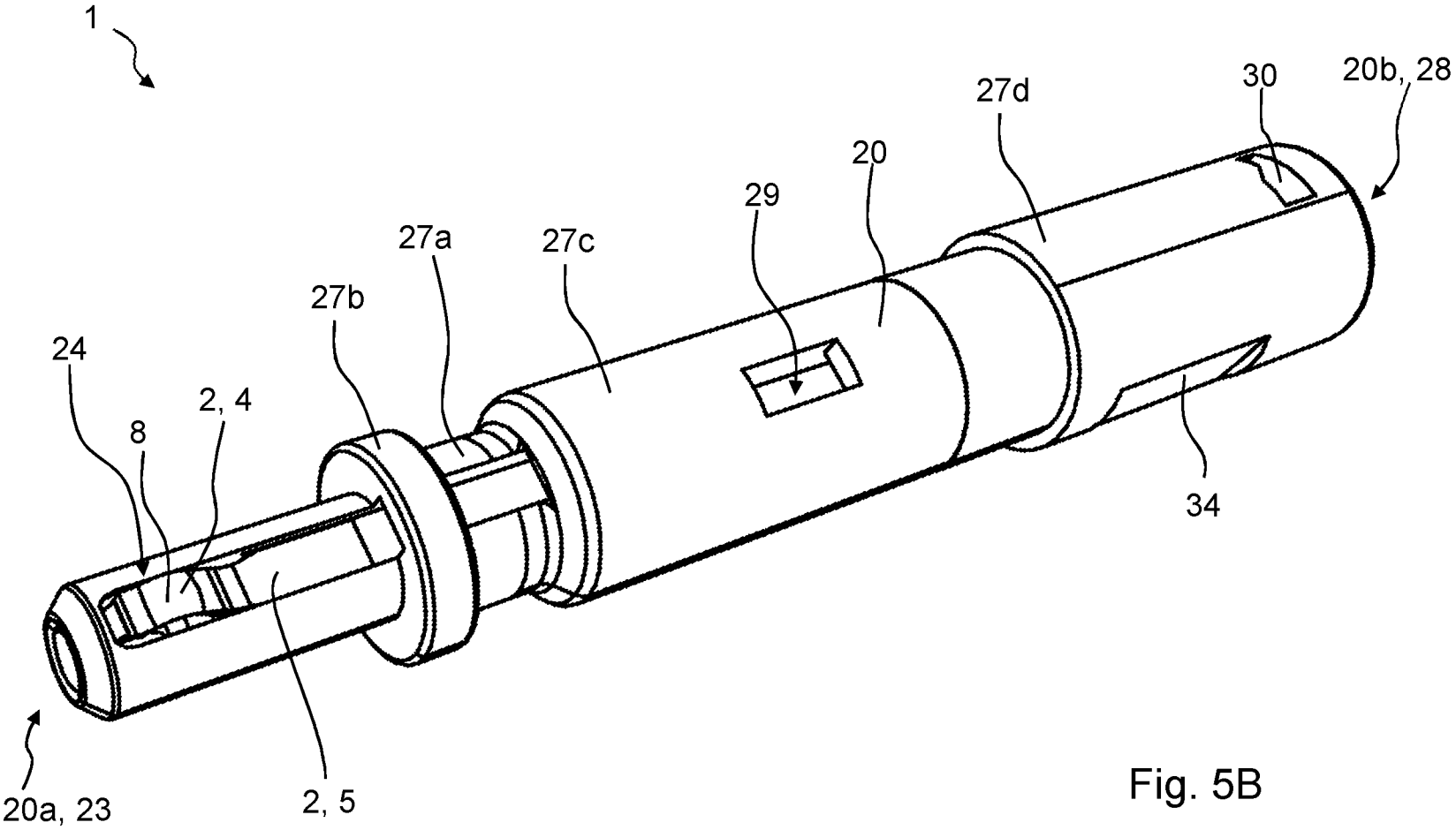

FIGS. 3A and 3B show various views of one embodiment of the housing 20. The housing 20 delimits a receiving space 21 that extends along the longitudinal direction 22 of the housing 20. The housing comprises an inner-conductor insertion opening 23 in its first end face 20*a* via which a short-circuiting inner conductor 50 of a multiway coaxial plug 41 can be inserted into the receiving space 21 at least over a part of its length and brought into electrical contact with the inner-conductor contact section 7. The housing 20 also has a laterally aligned outer-conductor contacting opening 24, wherein the outer-conductor contact section 8 of the contact spring 2 passes through the outer-conductor contacting opening 24 and can be brought into contact with an outer conductor 51. For this purpose, reference is made to FIGS. 5A and 5B which show the contact spring 2 placed into the housing 20. FIG. 5A shows that the contact spring 2 extends within the receiving space 21 over the predominant length of the housing 20.

The inner-conductor insertion opening 23 and the outer-conductor contacting opening 24 are separated from each other by a part 25 of the housing 20 and open into the common receiving space 21. Bearing surfaces 26 for the inner conductor 50 are also mounted in the receiving space 21 in the region of the inner-conductor insertion opening 23. In the exemplary embodiment shown, these bearing surfaces 26 are trough-shaped. The inner-conductor insertion opening 23 is preferably funnel-shaped and serves as a centering aid for receiving the inner conductor 50.

The housing 20 comprises a region 27*a* with a reduced diameter, which is surrounded by regions 27*b*, 27*c* with an enlarged diameter. A latching wing of the first multiway coaxial plug 40 can engage in the region 27*a* with the reduced diameter. This prevents the short-circuit probe 1 from being able to fall out of the first multiway coaxial plug 40. At the end of the short-circuit probe 1, there is a further region 27*d* with an enlarged diameter. The transition to this region 27*d* serves in particular as a stop which marks an end position of the short-circuit probe 1 when it is being pushed into the multiway coaxial plug 40.

FIG. 3B shows that the housing 20 of the short-circuit probe 1 has at least one gripping surface 34 on its outside, wherein the gripping surface 34 comprises a flat surface. The gripping surface 34 serves in particular to enable the housing 20 to be held securely in an automated placement. Alignment in a specific rotational and/or angular position is also possible via the gripping surface 34.

It is also shown that the housing 20 comprises several pairs of openings 29. These pairs of openings 29 are let into the housing 20 laterally and/or radially and are arranged on two opposite sides. In a top view of the housing 20, it is therefore possible to see through the housing 20 through respective pairs of openings 29. The pairs of openings 29 are important in the production of the housing 20 in an injection-molding process. Auxiliary tools can thus be inserted for bilateral support of the tool which is responsible for the formation of the receiving space 21. In this way, it is possible to prevent the high pressures at which the liquid plastic is injected into the mold from leading to a deformation or a bending out of shape of the tool which creates the receiving space 21. These pairs of openings 29 are arranged along the longitudinal direction 22 of the housing 20.

Figure 2B:
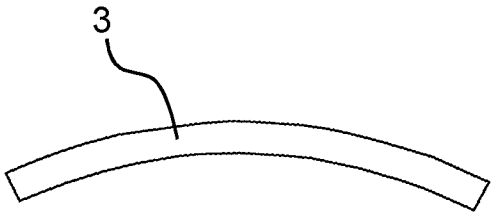
FIGS. 2A-2E: various detailed views of the contact spring of the short-circuit probe according to an embodiment of the invention from FIGS. 1A and 1B.
Figure 2A:
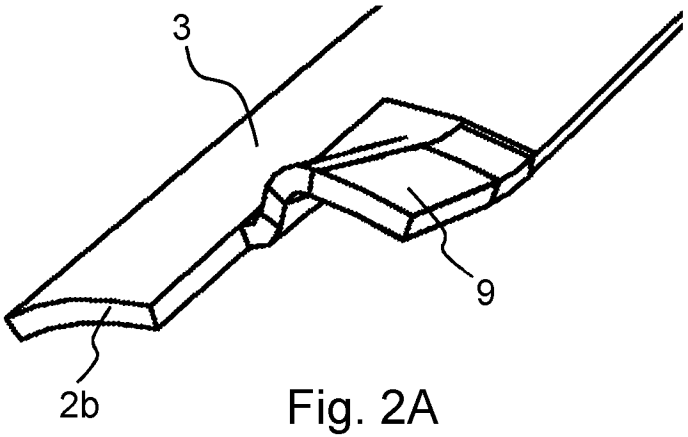

FIG. 2A shows the second end 2*b* of the contact spring 2. This is also the free end of the holding and stabilizing section 3. A corner region 9 of the free end of the holding and stabilizing section 3 at the second end 2*b* of the contact spring 2 is bent upwards without incisions, whereby a latching wing 9 is formed. In this context, "without incisions" can be understood to mean that the latching wing 9 is not notched out on its own, but is in particular produced completely by stamping. A stable latching wing 9 can thus be produced even with a very small thickness of the holding and stabilizing section 3. The corner region may be shortened relative to the other corner region.

Figure 6:
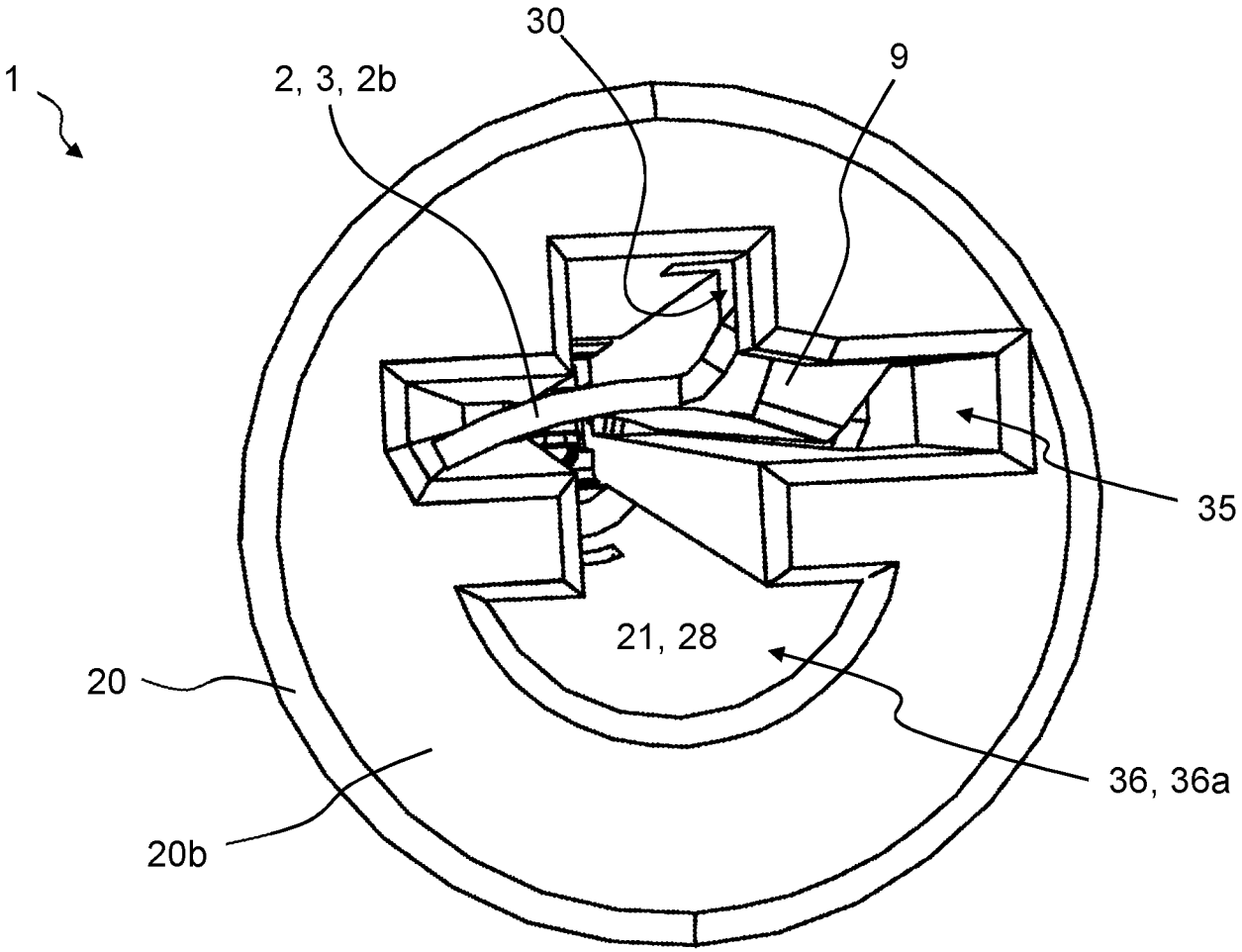

FIG. 6 shows how this latching wing 9 is arranged in the housing 20. The housing 20 in particular comprises an additional contact spring insertion opening 28 via which the contact spring 2 can be inserted into the receiving space 21. For this purpose, the housing 20 has a mounting groove 35 at its second end 20*b*. This is a component of the receiving space 21. Due to the curved profile of the holding and stabilizing section 3, the mounting groove 35 can be wider and thus be easier to produce. In this case, the mounting groove 35 runs horizontally. A further groove 36 crosses the mounting groove 35 preferably to form a right angle. This further groove 36 may have a widened end 36*a*. For example, assembly tools for inserting the contact spring 2 can be introduced into this.

Figure 4B:
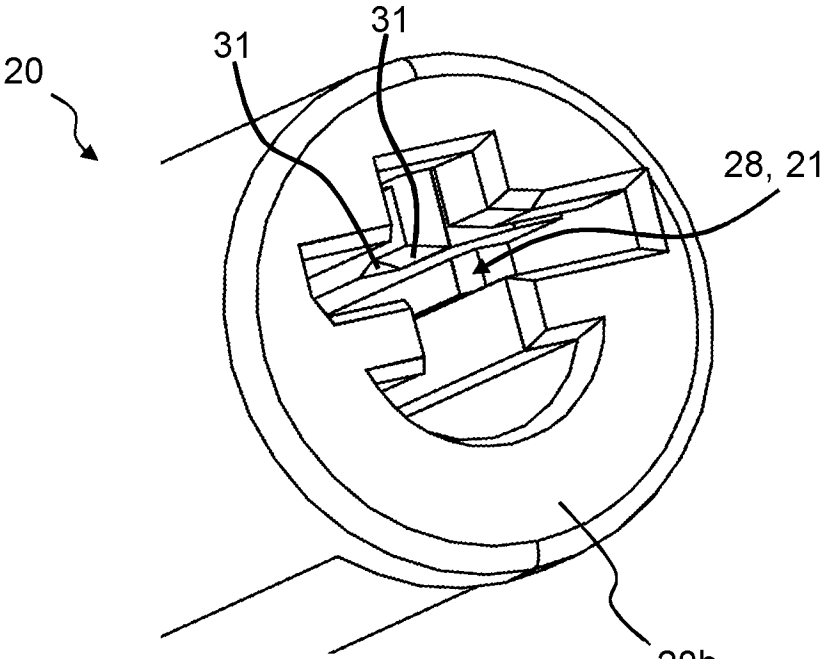
FIGS. 4A, 4B, 4C: various detailed views of the housing of the short circuit probe according to an embodiment of the invention from FIGS. 3A and 3B.
Figure 4A:
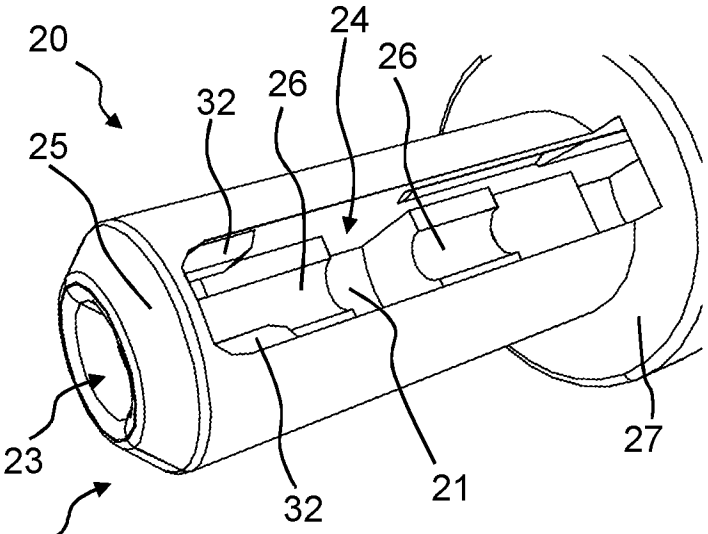
Figure 4C:
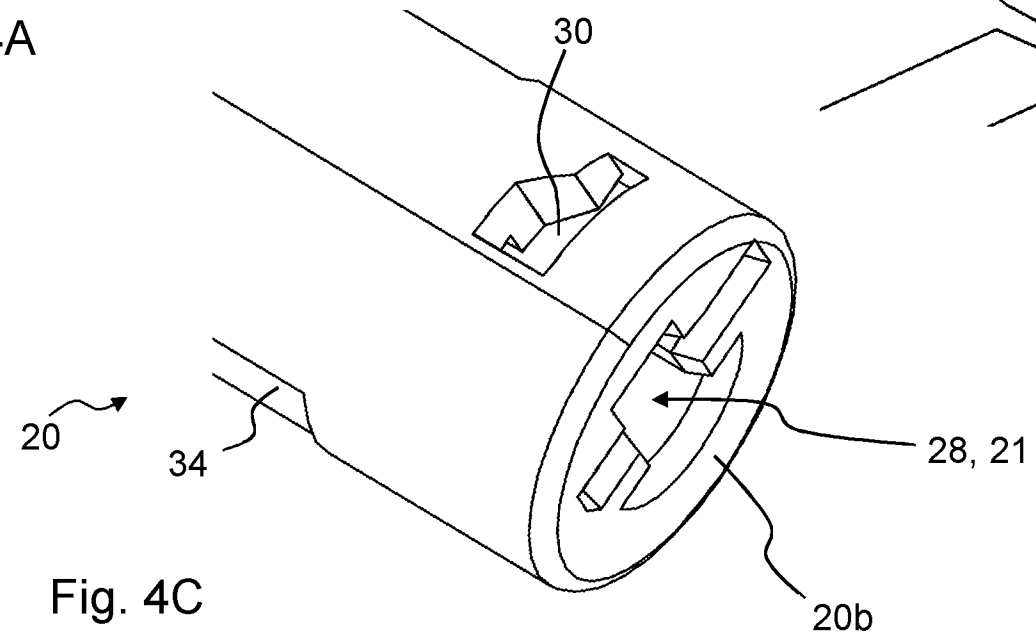

The contact spring insertion opening 28 is arranged in the region of a second end face 20*b* of the housing 20. The contact spring 2 is inserted into the contact spring insertion opening 28 with its contacting section 4 first so that stable holding of the contact spring 2 on the holding and stabilizing section 3 is possible for the duration of insertion. The contact spring 2 ends with its second end 2*b* inside the receiving space 21. Referring to FIGS. 4B and 4C, it is shown that a latching opening 30 is introduced in the housing 20. This is arranged in the region of the second end 20*b* of the housing 20. The latching opening 30 extends from an outside of the housing 20 into the receiving space 21. An inner wall 31 of the housing 20 within the receiving space 21 in the region of the latching opening 30 comprises a singly or multiply angled and/or rounded profile. This profile corresponds to the slope of the latching wing 9. This ensures that the latching wing 9 can correspondingly "deploy" when being pushed into the receiving space 21 and securely enters into the latching opening 30. The latching wing 9 can thereby be held in position despite pretensioning. The profile of the inner wall 31 rises in the direction of the second end 2*b* of the housing 2 in the direction of the latching opening 30.

In FIG. 2B, it is shown that at least the holding and stabilizing section 3 has a convex cross-sectional geometry.

As a result, the receiving space 21, which can comprise a mounting groove for the contact spring 2, can be enlarged in terms of its dimensions, which permits simpler production in injection-molding technology.

Figure 2C:
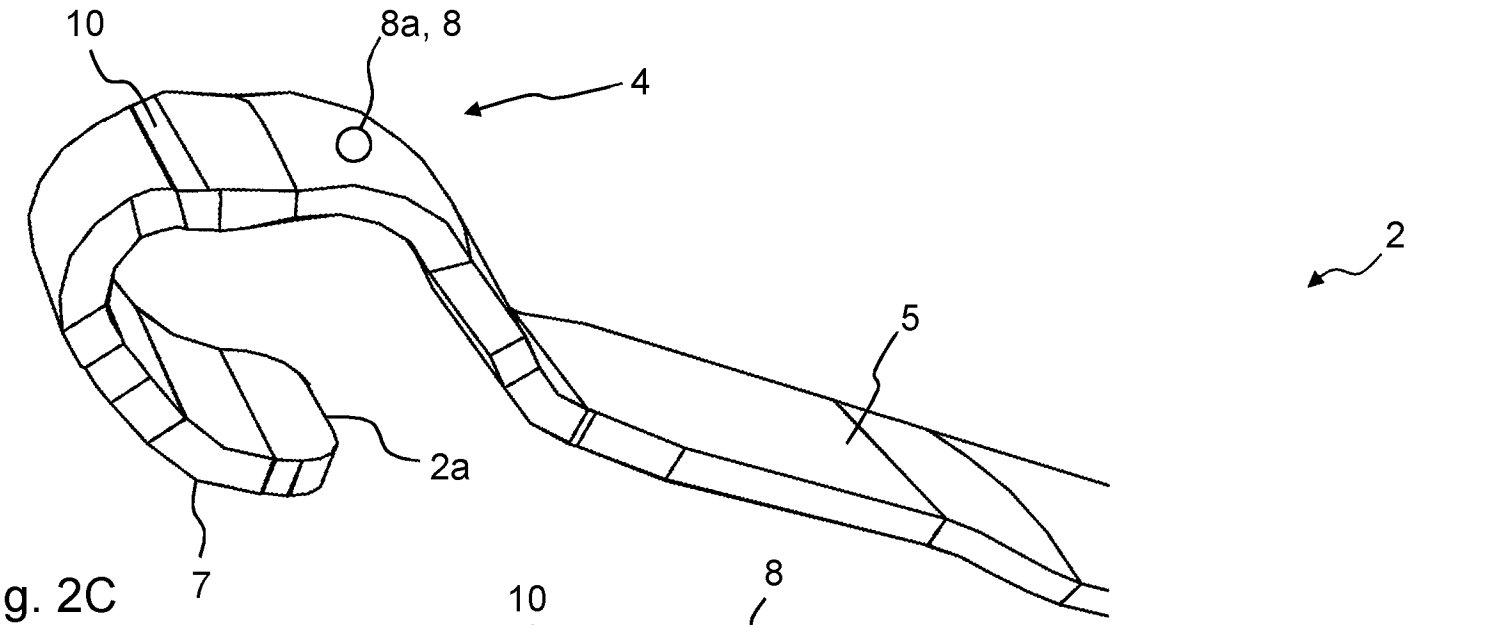
Figure 2D:
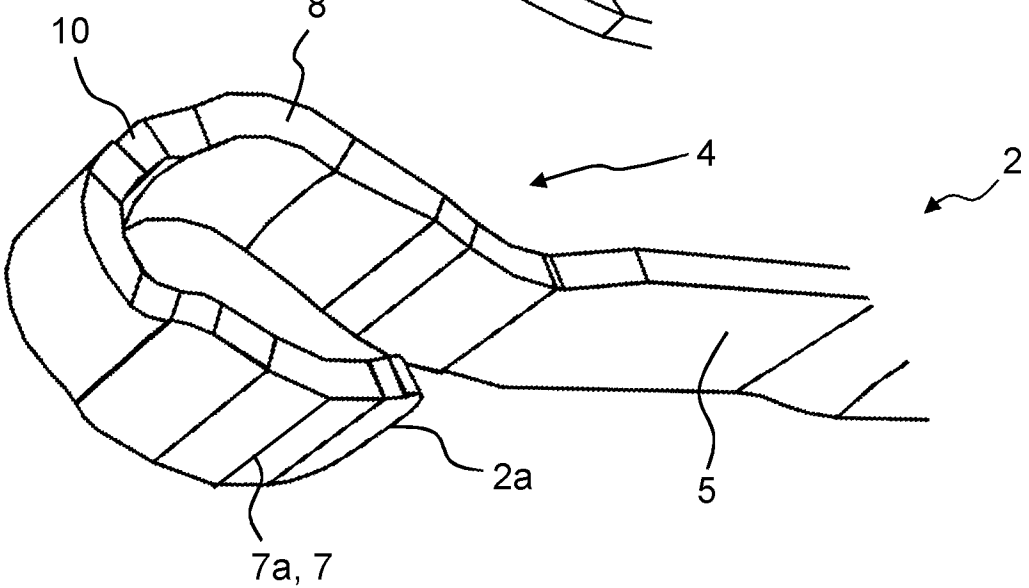

In FIGS. 2C and 2D, enlarged representations of an embodiment of the contacting section 4 are shown. The outer-conductor contact section 8 in FIG. 2C comprises a spherical contacting point 8*a*, whereby a punctiform contacting with the outer conductor 51 is possible. Instead of a spherical contacting point 8*a*, it is also possible to speak of a bulbous contacting point or a bulge which is convex in all directions. A punctiform and secure contacting of the inner wall of the outer conductor 51 is thereby achieved. Furthermore, damage to the inner wall of the outer conductor 51 is avoided, such as could happen if ridges or sharp edges were used at the corners. The spherical contacting point 8*a* slopes down in particular in all directions.

The inner-conductor contact section 7 to be seen in FIG. 2D comprises a linear contacting point 7A. In the exemplary embodiment, this extends over the entire width of the inner-conductor contact section 7. The linear contacting point 7*a* is preferably formed by a bending edge. A linear contacting of the inner conductor 50 is thereby possible.

Figure 2E:
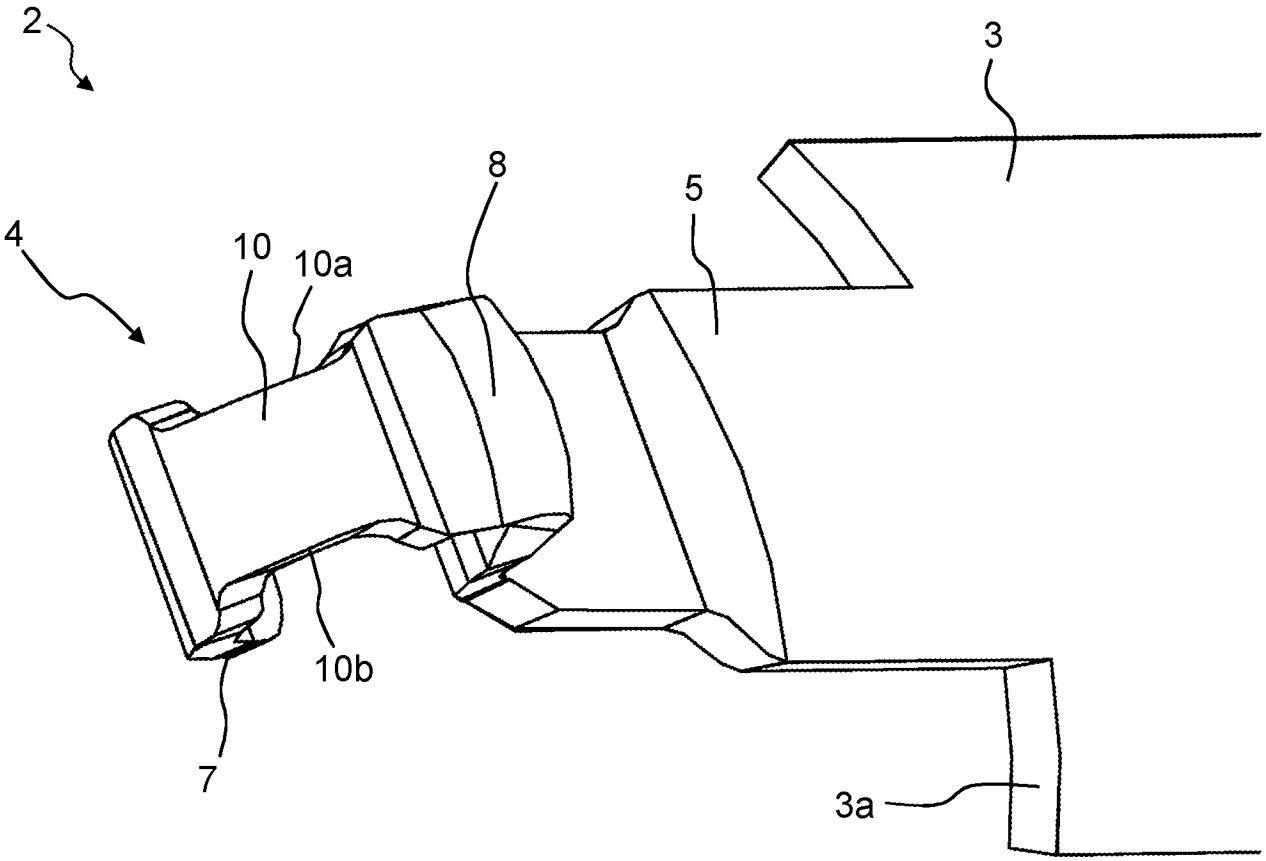

FIG. 2E shows another embodiment of the transition region 10 arranged between the inner-conductor contact section 7 and the outer-conductor contact section 8. This transition region 10 comprises an indentation 10*a*, 10*b* on both sides, for which reason the transition region 10 has a width which is reduced compared to the inner-conductor contact section 7 and the outer-conductor contact section 8. Referring to the enlarged view in FIG. 4A, which shows the first end 20*a* of the housing 20, it is shown that the housing 20 has ribs 32 in the region of the outer-conductor contacting opening 24 which protrude into the outer-conductor contacting opening 24 and into the indentations 10*a*, 10*b* in the transition region 10. The contacting section 4 of the contact spring 2 is thereby fixed and positioned. The ribs 32 preferably have a rising profile from the second end 20*b* in the direction of the first end 20*a* of the housing 20 so that the contacting section 4 is centered correspondingly when the contact spring 2 is being pushed into the contact spring insertion opening 28.

Figure 7:
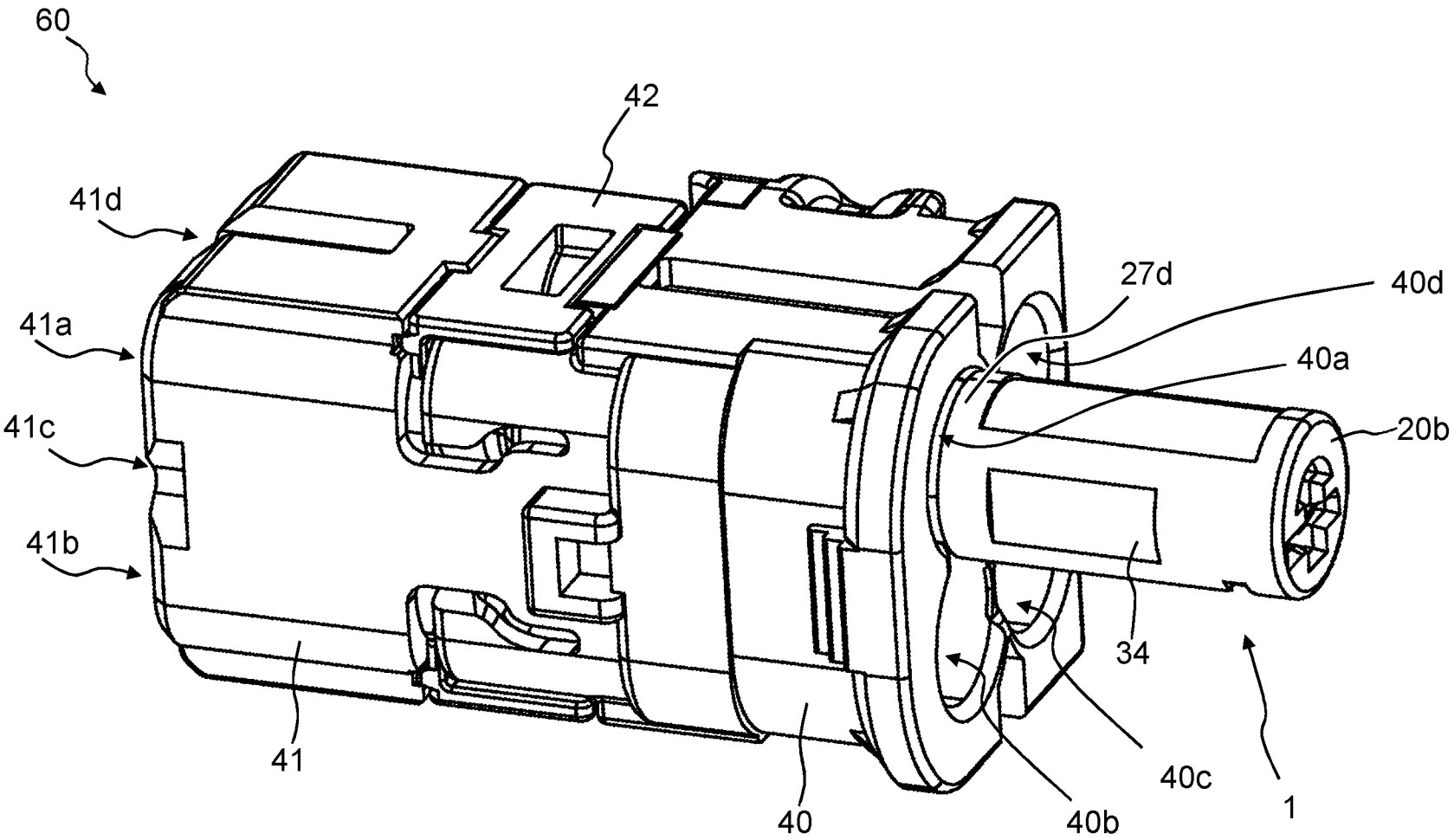
FIGS. 7, 8: a three-dimensional view of a first and a second multiway coaxial plug that have been plugged into each other to form a plug-in connection.
Figure 8:
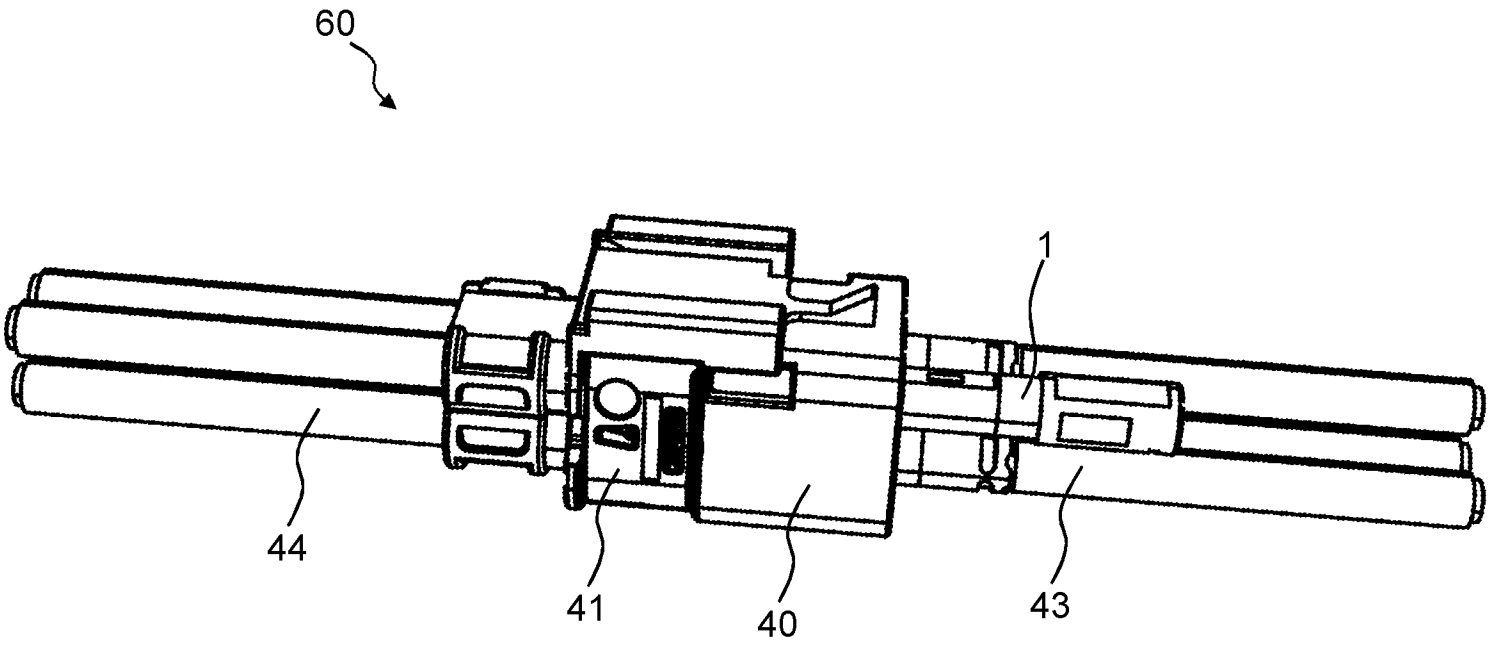

FIGS. 7 and 8 show a three-dimensional view of an embodiment of a plug-in connection 60 with a first multiway coaxial plug 40 and a second multiway coaxial plug 41. The two multiway coaxial plugs 40, 41 are plugged into each other and are also latched to each other via a coupling wing 42.

The first multiway coaxial plug 40 comprises four connections 40*a*, 40*b*, 40*c*, 40*d*. The short-circuit probe 1 is plugged into the first connection 40*a*. The remaining connections 40*b*, 40*c*, 40*d* are left unoccupied in FIG. 7 for greater clarity. In FIG. 8, coaxial cables 43 are plugged in. The second multiway coaxial plug 41 also comprises at least two connections 41*a*, 41*b*, 41*c*, 41*d*, wherein, according to FIG. 8, a coaxial cable 44 is arranged in each connection. Inner conductors 50 and outer conductors 51 are therefore arranged in the respective connections 40*a*, 40*b*, 40*c*, 40*d* and 41*a*, 41*b*, 41*c*, 41*d*. The inner conductor 50 in the first connection 40*a* of the second multiway coaxial plug 41 enters into the inner-conductor insertion opening 23 of the short-circuit probe 1 and contacts the inner-conductor contact section 7 of the contact spring 2.

Figure 9:
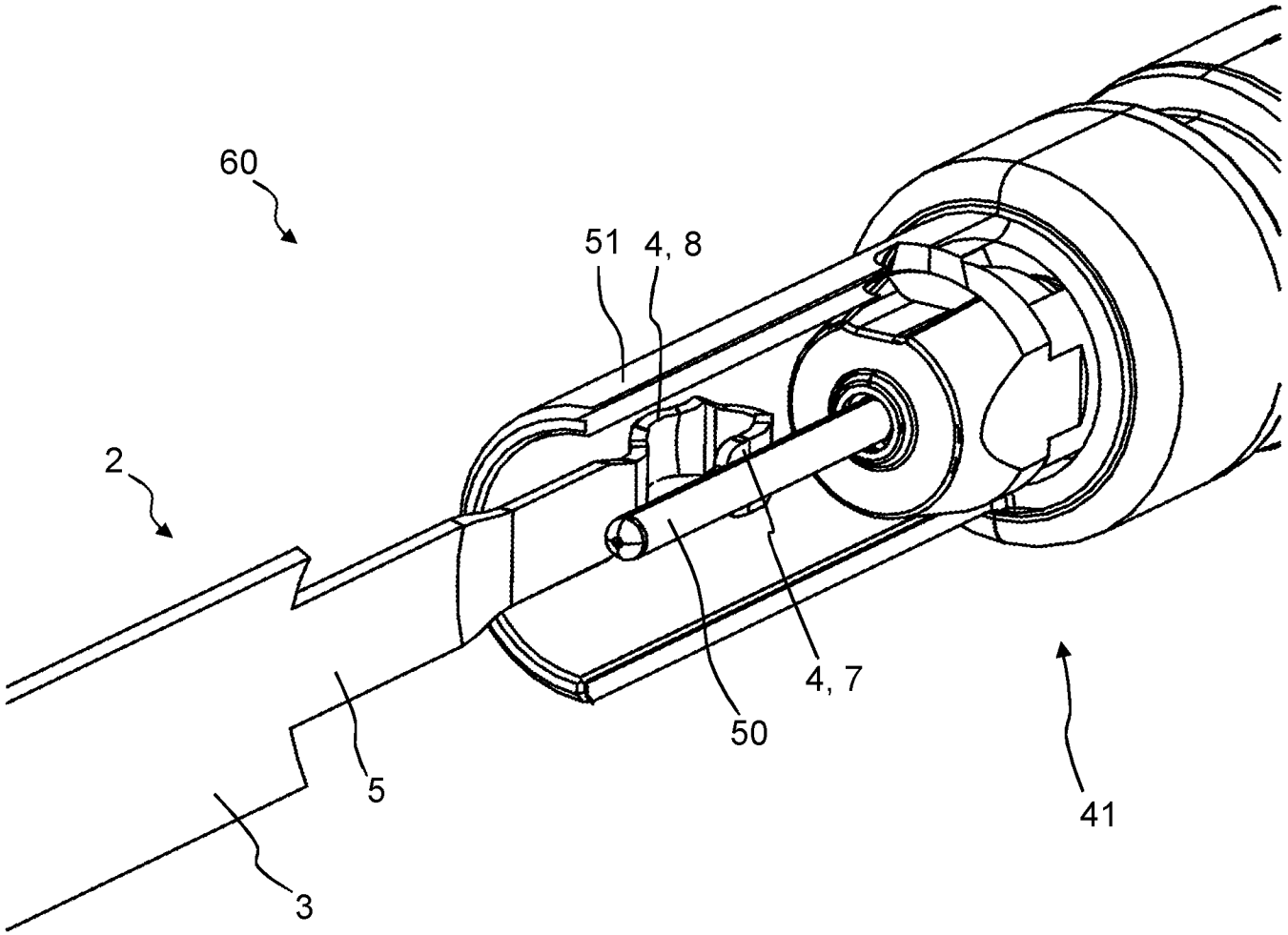
FIG. 9: a highly simplified representation from FIG. 8, which describes the short-circuiting of an inner conductor with an outer conductor.

This is shown in FIG. 9. The outer conductor 51 in the first connection 41*a* of the second multiway coaxial plug 41 contacts the outer-conductor contact section 8 of the contact spring 2, whereby the inner conductor 50 is electrically conductively connected to the outer conductor 51 and short-circuited. In the embodiment shown, the inner conductors 50 in the respective connections 41*a*, 41*b*, 41*c*, 41*d* of the second multiway coaxial plug 40 are connected to inner conductors of connected coaxial cables 44. The same applies to the outer conductors 51 in the connections 41*a*, 41*b*, 41*c*, 41*d* of the second multiway coaxial plug 41. The inner conductors 50 or outer conductors 51 in the further connections 40*b*, 40*c*, 40*d* of the second multiway coaxial plug 41 are at the same time electrically conductively connected to inner conductors or outer conductors, respectively, of coaxial cables 43 in the first multiway coaxial plug 40.

Figure 10:
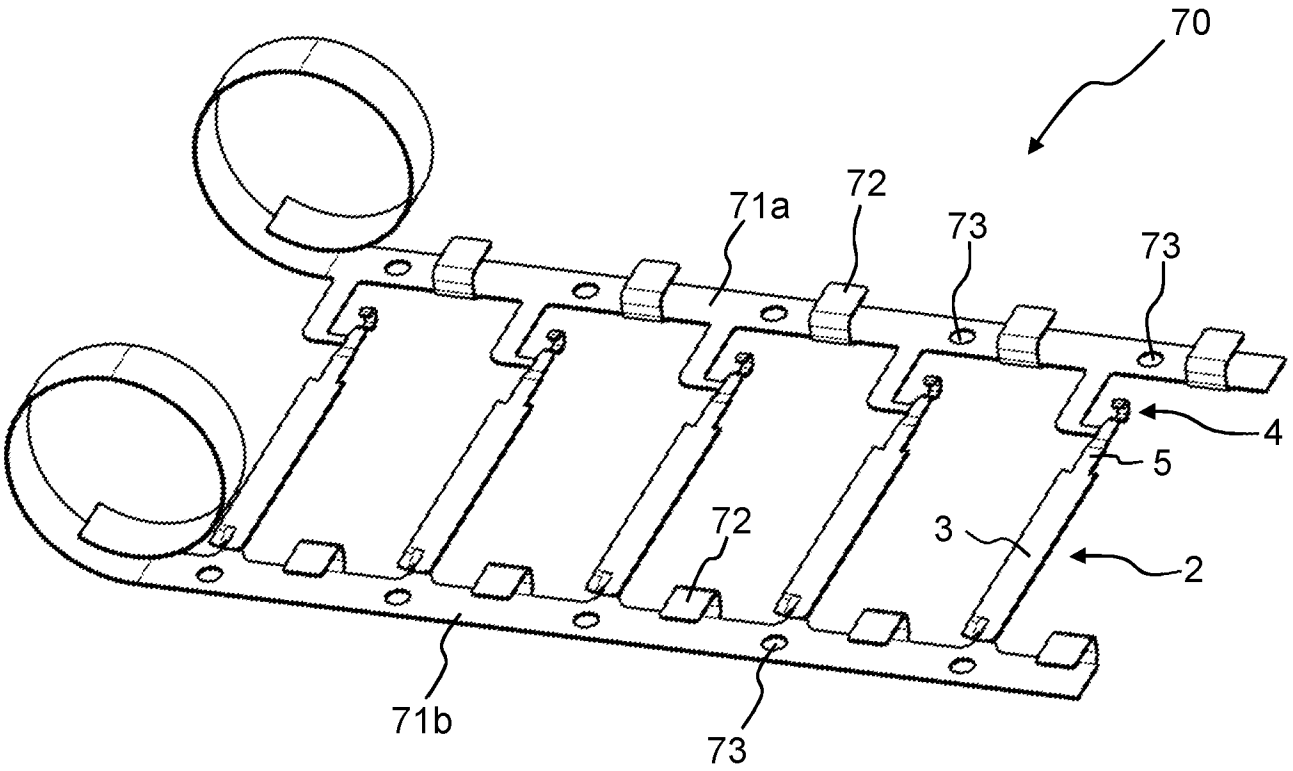
FIG. 10: an exemplary embodiment of a contact spring belt for the production of individual contact springs.
Figure 11:
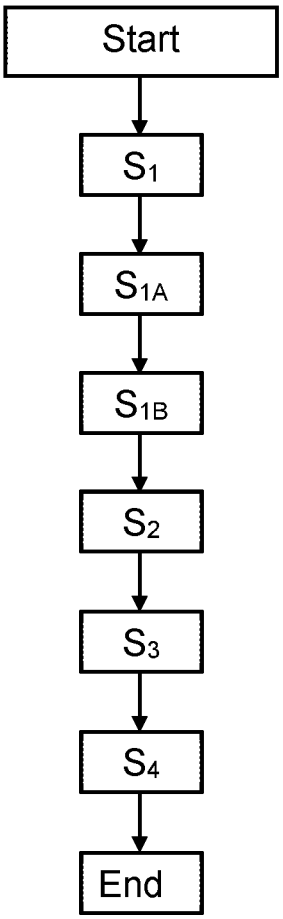
FIG. 11: a method which describes the production of individual contact springs and of the short-circuit probe according to an embodiment of the invention.

Referring to FIGS. 10 and 11, a method for producing the short-circuit probe 1 according to an embodiment of the invention is described. FIG. 10 shows an embodiment of a contact spring belt 70. This comprises a plurality of contact springs 2. Such a contact spring belt 70 is produced in method step S1. Method step S1 comprises method sub-step S1A. In this method sub-step S1A, a metal sheet is punched out. Contact springs 2 separated from one another are thereby produced. Each contact spring 2 comprises a holding and stabilizing section 3, a contacting section 4 and a connecting section 5. The connecting section 5 is arranged between the holding and stabilizing section 3 and the contacting section 4. The contact springs 2 are held together via a common upper connecting strip 71*a* and a common lower connecting strip 71*b*. The connecting section 5 of each contact spring 2 is connected to the upper connecting strip 71*a*, and the holding and stabilizing section 3 of each contact spring 2 is connected to the lower connecting strip 71*b* in the region of its respective free end.

In a further method sub-step S1B, the contacting section 4 is bent into an unciform shape. In this method step, the holding and stabilizing section 3 could also be given its convex shape. A latching wing 9 can also be introduced. The shortening of the latching wing 9 relative to the other corner region can take place in method step S1A.

In a further method step S2, the connecting section 5 is separated from the upper connecting strip 71*a*. This can take place by a stamping, cutting and/or lasering process.

In a further method step S3, the contact spring 2, which now no longer comprises an upper connecting strip 71*a*, is inserted into the receiving space 21 of the housing 20 via the contact spring insertion opening 28. The contact spring 2 can here be moved towards the housing 20 or the housing 20 can be moved towards the contact spring 2.

In a further method step S4, the holding and stabilizing section 3 is separated from the lower connecting strip 71*b*. This can take place by a stamping, cutting and/or lasering process.

In principle, in the method sub-steps S1A, spacer areas could also be left on the upper and lower connecting strips 71*a* and 71*b*, which project upwards and/or downwards from the respective connecting strip 71*a*, 71*b*. In the method sub-step S1*b*, these spacer areas could then be bent over to form spacers 72. The height of these spacers 72 is preferably greater than the height of the contacting section 4—bent into an unciform shape—of the respective contact fields 2.

Additionally or alternatively, in the method sub-step S1A, locking openings 73 could also be introduced into the upper connecting strip 71*a* and/or into the lower connecting strip 71*b*. This is preferably done at the position at which the respective contact spring 2 is arranged. When the housing 20 is being fitted out, a corresponding locking device (e.g., via gearwheels) of the automatic placement machine can engage in these locking openings in order to align the contact spring 2 securely and precisely, so that it can be introduced into the housing 20 with high precision.

The invention is not limited to the exemplary embodiments described. Within the scope of the invention, all described and/or drawn features can be combined in any way with each other.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A short-circuit probe for short-circuiting an inner conductor with an outer conductor in a multiway coaxial plug of a plug-in connection, the short-circuit probe comprising:

a contact spring for short-circuiting which consists of or comprises an electrically conductive material, the contact spring comprising a holding and stabilizing section and a contacting section, the contacting section being bent and comprising an inner-conductor contact section and an outer-conductor contact section which are spaced apart from one another perpendicularly to a longitudinal axis of the contact spring; and a housing comprising:

a receiving space extending along a longitudinal direction of the housing, an inner-conductor insertion opening in a first end face of the housing, via which the short-circuiting inner conductor of the multiway coaxial plug can be inserted into the receiving space at least over a part of its length and can be brought into contact with the inner-conductor contact section, and a laterally and/or radially aligned outer-conductor contacting opening, wherein the outer-conductor contact section of the contact spring passes through the outer-conductor contacting opening and can be brought into contact with the outer conductor, wherein the contact spring is arranged inside the receiving space of the housing and extends over a predominant length of the housing, and wherein:

the housing comprises a contact-spring insertion opening via which the contact spring can be inserted into the receiving space;

the contact-spring insertion opening is arranged in the region of a second end face of the housing, whereby the inner-conductor insertion opening and the contact-spring insertion opening are arranged at two opposite ends of the housing;

the receiving space connects the inner-conductor insertion opening to the contact-spring insertion opening; and the contact spring can be inserted or is inserted into the contact-spring insertion opening and thus into the receiving space with the contacting section first.

2. The short-circuit probe according to claim 1, wherein:

the inner-conductor insertion opening and the outer-conductor contacting opening are two openings separated from each other by a part of the housing; and/or the contact spring has no branches.

3. The short-circuit probe according to claim 1, wherein:

the contact spring comprises a connecting section, wherein the contacting section is connected to the holding and stabilizing section via the connecting section; and/or the inner-conductor contact section is bent back relative to the outer-conductor contact section and forms a first end of the contact spring, whereby the contacting section has an unciform shape.

4. The short-circuit probe according to claim 3, wherein:

the contact spring comprises a connecting section, wherein the contacting section is connected to the holding and stabilizing section via the connecting section;

the holding and stabilizing section is wider than the connecting section; and at a transition between the holding and stabilizing section and the connecting section, at least one stop face is formed on the holding and stabilizing section, the stop face being in contact with a corresponding stop counterface in the receiving space of the housing, whereby an end position of the contact spring within the receiving space is achieved.

5. The short-circuit probe according to claim 1, wherein:

a free end of the holding and stabilizing section is a second end of the contact spring; and the contact spring ends with the second end:

a) flush with the contact-spring insertion opening; or b) in a region of the contact-spring insertion opening.

6. The short-circuit probe according to claim 5, wherein:

a corner region of the free end of the holding and stabilizing section at the second end of the contact spring is bent without incision, whereby a latching wing is formed;

the housing comprises a lateral latching opening extending into the receiving space; and the latching wing of the contact spring is configured to engage in the latching opening such that a movement of the contact spring within the receiving space away from the inner-conductor insertion opening is prevented.

7. The short-circuit probe according to claim 6, wherein an inner wall in a region of the latching opening, which runs from the latching opening in a direction of the inner-conductor insertion opening, has a singly or multiply angled and/or rounded profile which corresponds to a slope of the latching wing.

8. The short-circuit probe according to claim 1, wherein at least the holding and stabilizing section of the contact spring has a convex cross-sectional geometry.

9. The short-circuit probe according to claim 1, wherein:

the outer-conductor contact section comprises a spherical contacting point, whereby a punctiform contacting with the outer conductor can be established; and/or the inner-conductor contact section comprises a linear contacting point which extends over an entire width of the inner-conductor contact section or over a predominant width of the inner-conductor contact section, whereby a linear contacting with the inner conductor can be established.

10. The short-circuit probe according to claim 1, wherein:

a transition region between the inner-conductor contact section and the outer-conductor contact section comprises an indentation on both sides such that the transition region has a width reduced in relation to the inner-conductor contact section and the outer-conductor contact section; and the housing has ribs in a region of the outer-conductor contacting opening which protrude into the outer-conductor contacting opening and into the indentations in the transition region and fix and/or position the contacting section of the contact spring.

11. The short-circuit probe according to claim 1, wherein the housing comprises at least one pair of openings, wherein the pair of openings are arranged on two opposite sides of the housing and wherein the receiving space is accessible through these openings.

12. A plug-in connection having a first multiway coaxial plug, a second multiway coaxial plug and the short-circuit probe according to claim 1, wherein:

the first multiway coaxial plug comprises at least two connections, wherein the short-circuit probe is arranged in a first connection and wherein an inner conductor and an outer conductor of a coaxial cable connected to the first multiway coaxial plug is arranged in a second connection;

the second multiway coaxial plug comprises at least two connections, wherein an inner conductor and an outer conductor are arranged in each connection;

the at least two connections of the first multiway coaxial plug and the at least two connections of the second multiway coaxial plug are plugged into each other;

the inner conductor in the first connection of the second multiway coaxial plug enters into the inner-conductor insertion opening of the short-circuit probe and contacts the inner-conductor contact section of the contact spring;

the outer conductor in the first connection of the second multiway coaxial plug contacts the outer-conductor contact section of the contact spring, whereby the inner conductor is galvanically connected to the outer conductor and short-circuited;

the inner conductor in the at least one second connection of the second multiway coaxial plug contacts the inner conductor in the at least one second connection of the first multiway coaxial plug;

the outer conductor in the at least one second connection of the second multiway coaxial plug contacts the outer conductor in the at least one second connection of the first multiway coaxial plug;

the inner conductors in the at least two connections of the second multiway coaxial plug are galvanically:

a) connected to inner conductors of connected coaxial cables; or b) connected to plug contacts that are solderable to a circuit board; and the outer conductors in the at least two connections of the second multiway coaxial plug are galvanically:

a) connected to outer conductors of the coaxial cables connected thereto; or b) connected to plug contacts that are solderable to a circuit board.

13. A method for producing the short-circuit probe according to claim 1 for short-circuiting an inner conductor with an outer conductor in a multiway coaxial plug of a plug-in connection, the method comprising:

producing a contact spring belt having a plurality of contact springs according to the following method sub-steps:

a) punching out and/or lasering a metal sheet to produce separate contact springs, wherein each contact spring comprises a holding and stabilizing section, a contacting section and a connecting section, wherein the connecting section is arranged between the holding and stabilizing section and the contacting section, wherein the contact springs are held together via a common upper connecting strip and a common lower connecting strip, wherein the connecting section of each of the contact springs is connected to the upper connecting strip and wherein the holding and stabilizing section of each of the contact springs is connected to the lower connecting strip in a region of a respective end, and b) bending the contacting section into an unciform shape;

separating the connecting section of a respective one of the contact springs from the upper connecting strip;

introducing the respective contact spring into a receiving space of a housing via a contact-spring insertion opening of the housing; and separating the holding and stabilizing section of the respective contact spring from the lower connecting strip.

14. The method for producing a short-circuit probe according to claim 13, wherein:

in the method sub-step of punching-out and/or lasering, spacer areas are left on the upper connecting strip and/or on the lower connecting strip, the spacer areas projecting upwards and/or downwards from the respective connecting strip, and, in the method sub-step of bending, the spacer areas are bent over to form spacers, a height of the spacers being greater than a height of the contacting section bent into the unciform shape of the respective contact spring; and/or in the method sub-step of punching-out and/or lasering, locking openings are introduced into the upper connecting strip and/or into the lower connecting strip at a position of the respective contact spring, wherein a longitudinal axis through the respective contact spring also extends over the corresponding locking openings in the upper and/or lower connecting strip.

15. A short-circuit probe for short-circuiting an inner conductor with an outer conductor in a multiway coaxial plug of a plug-in connection, the short-circuit probe comprising:

a contact spring for short-circuiting which consists of or comprises an electrically conductive material, the contact spring comprising a holding and stabilizing section and a contacting section, the contacting section being bent and comprising an inner-conductor contact section and an outer-conductor contact section which are spaced apart from one another perpendicularly to a longitudinal axis of the contact spring; and a housing comprising:

a receiving space extending along a longitudinal direction of the housing, an inner-conductor insertion opening in a first end face of the housing, via which the short-circuiting inner conductor of the multiway coaxial plug can be inserted into the receiving space at least over a part of its length and can be brought into contact with the inner-conductor contact section, and a laterally and/or radially aligned outer-conductor contacting opening, wherein the outer-conductor contact section of the contact spring passes through the outer-conductor contacting opening and can be brought into contact with the outer conductor, wherein the contact spring is arranged inside the receiving space of the housing and extends over a predominant length of the housing, and wherein:

a transition region between the inner-conductor contact section and the outer-conductor contact section comprises an indentation on both sides such that the transition region has a width reduced in relation to the inner-conductor contact section and the outer-conductor contact section; and the housing has ribs in a region of the outer-conductor contacting opening which protrude into the outer-conductor contacting opening and into the indentations in the transition region and fix and/or position the contacting section of the contact spring.

16. A short-circuit probe for short-circuiting an inner conductor with an outer conductor in a multiway coaxial plug of a plug-in connection, the short-circuit probe comprising:

a contact spring for short-circuiting which consists of or comprises an electrically conductive material, the contact spring comprising a holding and stabilizing section and a contacting section, the contacting section being bent and comprising an inner-conductor contact section and an outer-conductor contact section which are spaced apart from one another perpendicularly to a longitudinal axis of the contact spring; and a housing comprising:

a receiving space extending along a longitudinal direction of the housing, an inner-conductor insertion opening in a first end face of the housing, via which the short-circuiting inner conductor of the multiway coaxial plug can be inserted into the receiving space at least over a part of its length and can be brought into contact with the inner-conductor contact section, and a laterally and/or radially aligned outer-conductor contacting opening, wherein the outer-conductor contact section of the contact spring passes through the outer-conductor contacting opening and can be brought into contact with the outer conductor, wherein the contact spring is arranged inside the receiving space of the housing and extends over a predominant length of the housing, and wherein the housing comprises at least one pair of openings, wherein the pair of openings are arranged on two opposite sides of the housing and wherein the receiving space is accessible through these openings.

* * * * *